US008240239B1

(12) United States Patent
Diaz

(10) Patent No.: US 8,240,239 B1
(45) Date of Patent: Aug. 14, 2012

(54) GREEN ENERGY MINE DEFEAT SYSTEM

(76) Inventor: Kevin Mark Diaz, Watertown, MA (US)

( * ) Notice: Subject to any disclaimer, the term of this patent is extended or adjusted under 35 U.S.C. 154(b) by 0 days.

(21) Appl. No.: 13/184,505

(22) Filed: Jul. 16, 2011

(51) Int. Cl.
*F41H 11/16* (2011.01)

(52) U.S. Cl. ..... 89/1.13; 102/402

(58) Field of Classification Search ..... 89/1.13; 102/402; 86/50
See application file for complete search history.

(56) References Cited

U.S. PATENT DOCUMENTS

| | | | | |
|---|---|---|---|---|
| 2,005,392 | A | 4/1933 | Remus | |
| 2,419,308 | A | 4/1947 | Austin | |
| 3,820,479 | A | 6/1974 | Fylling | |
| 3,837,259 | A * | 9/1974 | Vaughn | 89/1.13 |
| 4,467,694 | A * | 8/1984 | Azulai et al. | 89/1.13 |
| 4,552,053 | A * | 11/1985 | Bar-Nefy et al. | 89/1.13 |
| 4,585,387 | A | 4/1986 | Jayne | |
| 4,621,562 | A * | 11/1986 | Carr et al. | 89/41.05 |
| 4,727,940 | A * | 3/1988 | Bar-Nefy et al. | 171/84 |
| 4,901,644 | A * | 2/1990 | Nevins et al. | 102/293 |
| 4,919,034 | A * | 4/1990 | Firth | 89/1.13 |
| 4,932,831 | A * | 6/1990 | White et al. | 414/732 |
| 4,938,114 | A * | 7/1990 | Matthews et al. | 89/1.13 |
| 5,097,911 | A * | 3/1992 | Kendall | 172/815 |
| 5,125,317 | A | 6/1992 | Spektor | |
| 5,263,809 | A * | 11/1993 | Kent | 414/680 |
| 5,307,272 | A * | 4/1994 | Butler et al. | 700/90 |
| 5,410,944 | A | 5/1995 | Cushman | |
| 5,648,901 | A | 7/1997 | Gudat | |
| 5,786,542 | A * | 7/1998 | Petrovich et al. | 89/1.13 |
| 5,856,629 | A | 1/1999 | Grosch | |
| 5,892,360 | A * | 4/1999 | Willer et al. | 324/326 |
| 5,988,037 | A * | 11/1999 | Haughom et al. | 89/1.13 |
| 6,113,343 | A * | 9/2000 | Goldenberg et al. | 414/729 |
| 6,343,534 | B1 | 2/2002 | Khanna | |
| 6,377,872 | B1 * | 4/2002 | Struckman | 700/258 |
| 6,393,959 | B1 * | 5/2002 | Amemiya | 89/1.13 |
| 6,681,675 | B2 * | 1/2004 | Miller | 86/50 |
| 6,809,520 | B1 | 10/2004 | Nelson | |
| 6,879,878 | B2 | 4/2005 | Glenn | |
| 7,198,112 | B2 | 4/2007 | Wanner | |
| 7,228,927 | B2 | 6/2007 | Hass | |
| 7,493,974 | B1 | 2/2009 | Boncodin | |
| 7,540,240 | B2 | 6/2009 | Carlier | |
| 7,565,941 | B2 | 7/2009 | Cunningham | |
| 7,600,460 | B2 * | 10/2009 | Manders | 89/1.13 |
| 7,683,821 | B1 | 3/2010 | Clodfelter | |

(Continued)

FOREIGN PATENT DOCUMENTS

EP 2133652 A2 12/2009

(Continued)

OTHER PUBLICATIONS

Bourke, Impact Protection Canopy, Sep. 16, 2010, WO/2010/103014.

*Primary Examiner* — Benjamin P Lee

(57) ABSTRACT

A semi-continuous duty, Green Technology, self-charging 14, unmanned electric vehicle providing protection and security from underground mines. A deflector blade 11 follows natural existing contours to maintain straight line paths, while simultaneously carrying a mine detector 10, a vertical reciprocating ram set 30, 32 and 33 that preloads soil while also creating forward motion, followed by an energy dissipation and containment canopy system 22, 24, 26 & 29. The comprehensive system provides protection from mines on existing pathways in desert environments using a self-sufficient energy source. In addition, the total system utilizes only Green Technology for all modes of operation.

33 Claims, 4 Drawing Sheets

U.S. PATENT DOCUMENTS

| | | | | |
|---|---|---|---|---|
| 7,712,405 | B2 * | 5/2010 | Toycen et al. | 86/50 |
| 7,752,953 | B2 * | 7/2010 | Sokol et al. | 89/1.13 |
| 7,884,569 | B2 | 2/2011 | Ward | |
| 2007/0107917 | A1 | 5/2007 | Doherty | |
| 2008/0236376 | A1 * | 10/2008 | Reeves et al. | 89/1.13 |
| 2008/0262669 | A1 | 10/2008 | Smid | |
| 2009/0223355 | A1 * | 9/2009 | Manders | 89/1.13 |
| 2009/0250276 | A1 * | 10/2009 | Goodwin et al. | 180/65.265 |
| 2010/0275472 | A1 * | 11/2010 | Cunningham | 37/403 |

FOREIGN PATENT DOCUMENTS

| | | | |
|---|---|---|---|
| EP | 2264395 | A2 | 12/2010 |
| EP | 2275773 | A2 | 1/2011 |
| FR | 2849178 | A1 * | 6/2004 |
| GB | 2321882 | A * | 8/1998 |
| WO | WO 2005097432 | A1 * | 10/2005 |

* cited by examiner

GREEN ENERGY MINE DEFEAT SYSTEM

BACKGROUND

Prior Art

The following is a tabulation of some prior art that presently appears relevant:

U.S. Patents

| U.S. Pat. No. | Kind Code | Issue Date | Patentee |
|---|---|---|---|
| 7,493,974 | B1 | Feb. 24, 2009 | Boncodin |
| 5,856,629 | | Jan. 5, 1999 | Grosch et al. |
| 6,343,534 | B1 | Feb. 5, 2002 | Khanna et al. |
| 2,005,392 | | Apr. 18,1933 | Remus |

This invention relates to a solar charging, battery powered, unmanned mine defeat vehicle. Current situations in specific geographic regions of the world have created a new need for defeating underground mines in desert-like terrain. This vehicle is especially to be used on existing paths in sand environments worldwide to protect against death and dismemberment, a long-time priority issue and establishes an effective tool for safe passage and security monitoring and creating secure zones. Both the facts of presence of underground mines as well as the importance of deterrence and prevention of positioning new mines are widely available to individuals. The necessity for addressing the issue of travel protection by foot on paths consisting of bare ground is the focus of the new vehicle as presented. The invention has the advantage of operating with Green Technology only and in areas that do not have conventional AC (alternating current) for charging or common petroleum based fuel sources for conventional gas engines.

The unfilled need for defeating mines in environments such as opens fields, village passages and trails between villages has always needed a method of solution. As the use of mines was common for numerous years, millions of mines are located and placing an equivalent number of humans at risk. Many solar powered vehicles exist but do not comprehensively address mines. Many methods exist for the protection from mines for personnel vehicles. Recent studies have indicated that a new degree of effort must be made spent into the success of what is first step to defeat of mines, that of limiting the placement of them. Thus creating the benefit of secure areas. Proactive security and containment is simultaneously performed as the vehicle functions to prevent further placements of mines.

Several types of solar vehicles and minesweepers for detection and destruction of mines are known, each with a disadvantage. Many solar powered vehicles exist but do not comprehensively address mines. Many methods exist for the protection from mines for personnel vehicles and utilizing unmanned robots. The previous patent for a solar vehicle U.S. Pat. No. 7,493,974 to Boncodin is for human transportation. A minesweeping vehicle, U.S. Pat. No. 5,856,629 granted to Grosch et al. is for wide-open spaces. U.S. Pat. No. 6,343,534 to Khanna et al utilizes many latest methods for detection without a simultaneous in place trigger and containment system or marking process. The previous U.S. Pat. No. 2,005,392 to Remus addresses the use of a deflector with the disadvantage of flat surface use only.

This equipment clears a minimum, substantial 32 inch wide path, for personnel in single file traversing pathways with detection, verification, sensors, surveillance, disarming, detonation, containment and path marking all in one process. This method of defeating a mine keeps people and personnel at a distance from the hazard with prevention, simultaneously. Pressure wave, fire and fragmentation from all mines occur within milliseconds of triggering the device and it is necessary to defeat this type of device from placement to containment, specifically anti-personnel type mines. The one vehicle makes available the necessary functions of soft protection methods and direct mechanized means. This addresses the two-part problem of mines, protection from initial placement while also providing safe detection, removal and containment, a combined comprehensive approach to defeating mines.

SUMMARY

It is the objective of the present invention to create a new use for a solar powered vehicle to provide a improved combined compact mine detector, monitor and sweeper and containment apparatus in the most austere environments to run without conventional fuel driven power using only Green Technology. The vehicle is a battery based DC (direct current) motor drive recharged with a solar module attached onto the forward sloping frame. It does not require daily fueling. Introducing equipment that is designed to be small in size and intended to be durable and cost sacrificial utilizing mechanical and detection means having the advantage of self-contained capabilities. The goals and approach are solely based on control of spaces at risk to mine placement and provide a cost-effective, high performance solution with known survivability limitations and budget-sacrificial equipment loss and only life saving and casualties reduction made as a variables of measured value.

Operation speed and maneuvering including tight turning is afforded by the fact of equal wheel base to track width yielding nearly a zero turning radius. Any of the customary control methods are possible, including remote or wired joystick as leader-follower arrangement, satellite, or run automatically on memory-learned pathways for routine path mine checking.

Common current field practice operating unmanned vehicle involves avoiding and maneuvering around debris and small stones and rocks, which lay in a straight-line path between two points of the objective route. In order to remedy this in an efficient condition of operation, an alternative method is made available as an option to drive in more direct pathways. A preferred method of ground preparation is to produce a near free of debris surface as possible. As an advantage, a debris deflector that has multiple panel segments, which naturally track downward onto the existing path cross-section, carries out ground preparation. The self-leveling debris deflector is counterweighted for a net self-weight of approximately a 3-pound net downward force per segment. The assembly remotely retracts for transportation to site. The assembly remotely retracts for protection during deactivation attempts or detonation.

Remote retractable robotic arm is deployed from recessed chamber to execute disarming when desired. Optional sensors read incoming path profile and controls deflector and probe assembly. The feedback loop created maintains a telemetry system for all ground sensors. Procedure also may include sidestepping mine and installing a flag for the affected area.

For normal conditions, the vehicle travels and a simultaneous area proofing and containment countermeasure system operates, a new countermeasure for field use. A specifically arranged configuration and assembly for replicating foot motion and pressure with a compound articulating mechanism is employed. A controlled pressure (0 to 30 psi) vertical reciprocating system for mine activation is utilized for positive soil contact and pressure to be delivered across the width of the vehicles pathway. A curtain billows, plate and canopy system for detonation dampening for expansion is utilized. A secondary fast response counter deployment system for canopy ejection is also presented.

The placement prevention of mines is simultaneously done in a passive format through constant motion and personnel verification using a 360-degree turret to create safe-zones, which is a primary focus for all countries. In each typical village, small areas shall benefit, primarily villages and village connecting trails. Rotation of the camera of 45 degrees to left and right provides 360 degree of coverage with the turret operational. The majority of mines are delivered and set in place by individuals or groups who reside outside the community or village at risk. As an advantage in the self-contained and efficient capabilities, the vehicle is able to continuously perform motion detection and identification checking, through this simple but new effective data gathering technique.

At the rear of the containment plate are mounted three trailing hooks left, center and right.

A path marking system for centerline and low spot paint applicator is the last apparatus mounted.

As an improvement accessory, where the surrounding terrain requires a better traction, the vehicle has the ability of use of additional flexible tracks to be field installed.

Adjustment for width of path utilizing all or any these devices is possible for wider or narrower path requirements.

DRAWINGS

Figures

DRAWINGS

Reference Numerals

| | |
|---|---|
| 1 | turret |
| 2 | canopy |
| 3 | camera |
| 4 | slide black Box |
| 5 | rear Blast plate |
| 6 | flag deployment system |
| 7 | vertical reciprocating system |
| 8 | concealed robotic arm system |
| 9 | self leveling system |
| 10 | detector |
| 11 | deflector |

-continued

| | |
|---|---|
| 12 | $2^{nd}$ Camera |
| 13 | glass |
| 14 | solar Module |
| 15 | photo voltaic cells |
| 16 | wheels |
| 17 | chassis-body |
| 18 | DC motors |
| 19 | batteries |
| 20 | turret |
| 21 | chassis-body |
| 22 | gas system |
| 23 | gas tanks |
| 24 | canopy |
| 25 | curtain billows |
| 26 | rear blast plate |
| 27 | mounting rod |
| 28 | spline control bracket |
| 29 | strut-cartridge |
| 30 | strut-cartridge |
| 31 | apron |
| 32 | vertical reciprocating power-head |
| 33 | axial actuator |
| 34 | wheel |
| 35 | remote deployable flag |
| 36 | open edge |
| 37 | trigger |
| 38 | anchor base |
| 39 | powder actuated anchor |
| 40 | open edge |
| 41 | optional additional anchor base |
| 42 | spring to rod connections |

DETAILED DESCRIPTION OF EMBODIMENTS

Figure 1:
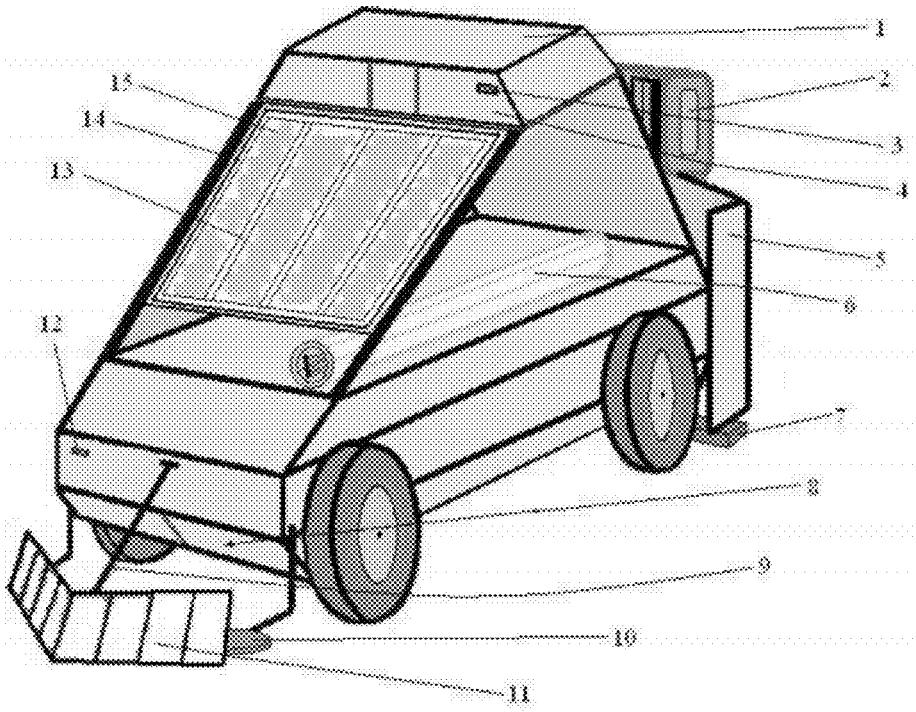
FIG. 1 is a perspective schematic view of a solar powered minesweeping vehicle according to the preferred embodiment of the invention.
Figure 2:
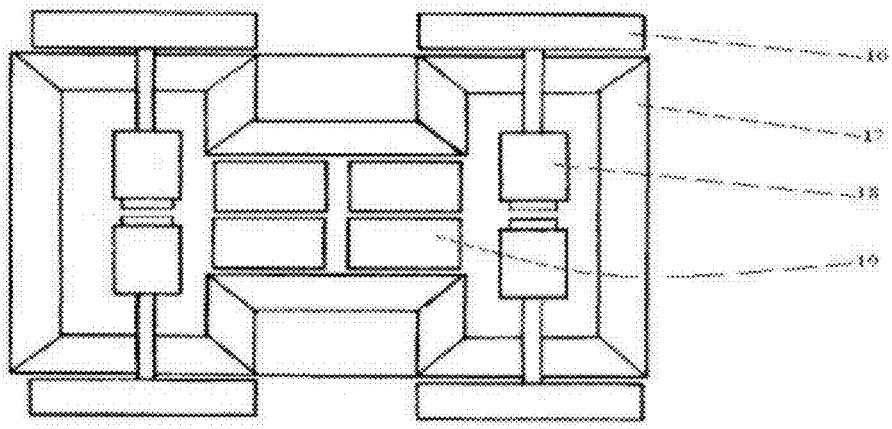
FIG. 2 is an interior schematic section showing the chassis-body-drive arrangement.

As shown in FIG. 1, is a new use non-conventional sized battery powered, solar charged, unmanned vehicle that is sized so as to create a clearing path for people travelling on foot. The first apparatus 11 is the self-leveling debris deflector. The primary chassis contains a solar panel 14 with a high resistant and magnification surface 13. From FIG. 2, a vertical interior section view looking down with the four drive wheels 16 can be found. Inside the chassis 17 are normal DC drive motors 18, current controller means and the battery set 19. The top of the chassis provides space for an optional bio-fuel power-plant that is not necessary but would provide added daily service hours that may be of advantage. In front of the chassis is an optical camera 12 for close in monitoring of operation of robotic arm that is stored in a recessed chamber 8 and for warning flag positioning. Above the chassis is a structural frame, which acts to support the photovoltaic cell module 14. This panel is secured to the frame with isolation attachments should an event causing toppling occur. The panel surface is damage resistant.

The supporting frame is also a shock cage, which has internally telescoping cylinders for force dampening. Above the shock cage is the turret 1 which is able to swivel horizontally 355 degrees. The turret 1 contains two optical cameras 3, one forward that creates 3D vision when synchronized with the lower chassis camera 12 and one to the rear for real time monitoring and motion detection and verification. Motion to identity security containment and control is accomplished. This significantly protects those registered in the safe zones and residing in the secured areas with personnel and civilians using IC Card verification. A simultaneous process of motion detection with verification of safe zone identification signals is read by computer hardware in the black box 4. Establishing this security process in any area of mine placement activity defends against further mines from being placed. The onboard capacity contains the logistics that would assemble information into a centralized database for use with and for field personnel to access this remote mobile vehicle. Information integration and analysis becomes real time. Verifying ID, document check, and controlling a single identification is extremely crucial as the ease of multiple identities is wide spread. Selective biometric applications involving identification cards containing radio frequency capacity technology for control movement in secured zones. Modernization programs rely on individual identification cards being required to carry. The following soft approach abilities for data gathering are presented for use in an efficient integrated fashion at low cost. Each optical camera is included in a self-contained blast resistant removable black-box 4, one on each side of the turret, which contain operational control and communications integrated circuits and hardware. The turret is also supported from the rear by the back wall, hinged at the top, for additional dampening benefit.

The self-leveling and retractable debris deflector 11 is illustrated in FIG. 1. Each panel section is slightly angled from the vertical and from the path centerline forward, so as to give a rolling momentum impact force out and away from the path of vehicle. Each panel segment is connected by a simple hinge-pin mounted at mid-panel height. The panels are overlapped so as to create uniform coverage while sloping up or down on the path's surface. From the existing ground surface, tines are placed which act to catch and clear individual stones larger than ¾ inch round in size. The deflector panel assembly is fitted with guide rollers, which produce very little downward force when not mechanically controlled with a height sensor controlled system. The assembly is supported by two side arms that act to maintain a controlled forward projected distance from the chassis and allow for upward rotation retractability when not in use. The total assembly creates a self-leveling effect. Immediately behind deflector panel assembly is mounting table and detection device 9.

The primary countermeasure system is illustrated in FIG. 1 and is a new assembly or unique apparatus for simultaneous triggering and containment of mines. The three features are shown at the rear of the vehicle. The vehicle may work in reverse direction where hazards are extremely high to maximize containment advantages. At the rear of the vehicle a vertical reciprocating system is shown 7, followed by a containment plate 5 and covered by a canopy deployment system 2.

Figure 3:
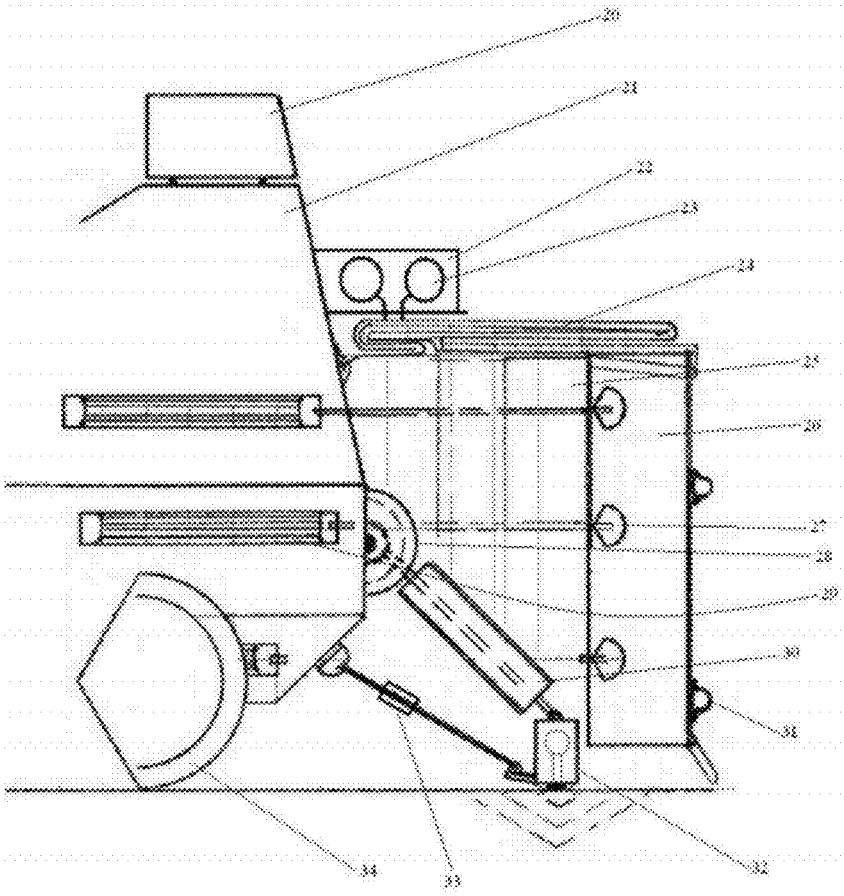
FIG. 3 is a side elevation schematic view depicting the configuration of the mine countermeasure system.

From FIG. 3, the rear of the vehicle can be seen. At the ground surface, each reciprocating foot 32 assembly has a determined width, which applies the appropriate pressure based upon the range of in-situ soil shear strength present where mine detection is to take place. The advantageous feature being created is that the reciprocating system assembly self-propels itself in two distinct ways. First, the individual line of action is inclined a few degrees from vertical, as a foot does. Secondly, the lower control arm has an axial actuator, which has a controlled advance throughout the timed cycle of operation. Each foot has a power head that provides a means of rotation and a controlled variable positive soil displacement, which acts to alter soil at or below surface and accomplish the mine trigger objective by simulating foot pressure and motion.

The modular, preloaded feet with reciprocating probes are signaled to cycle in a timed fashion for maximizing the net downward force. Downward force for each assembly is provided by a preloaded pressurized strut 30, supported by a vertical spline control bracket 28, which limits horizontal range. The configuration of this apparatus is designed to remain in a horizontal orientation for existing ground undulations of plus or minus three inches and maintain continual ground contact.

Behind the vehicle chassis 21 is a containment blast plate 26, positioned upon status change to encompass the projected inverted conical zone of pressure, fire and fragmentation. Connecting the chassis to the blast plate is one variant of gas-fluid cartridges 29 with stepped release (0-200-800 lbs), which are body to plate connected, used as a dampening struts. The entire assembly is raised and lowered when not in use.

The billows 25 and curtain 25 are attached and assembled in accordion like manner on and along the sides of the containment space. The canopy 24 is attached in a folded parachute manner. Both are of a blast resistant material such as carbon fiber or better. As the mine is triggered, the blast plate and vehicle are lifted and sent in different directions. The blast travel distance is slightly less in distance to the blast plate 26. Therefore, initially causes a reverse direction of the total assembly. Through this action and the gas-fluid cartridges 29, energy is dissipated with a reaction being centrally resisted by the mass and size of the reciprocating system.

As those reciprocating system parts that are in ground contact and above are broken away as a reaction to the mine detonation, a feedback loop is broken and a fail safe signal located along the feet is tripped on, when the connection is broken. The connecting arms are limit rated and are subject to the first and highest levels of stress. Upon the signal being sent to the optional gas ejection system 22, a propelled inert gas and fire suppression 23 system is activated for canopy deployment in an upward and reverse impulse direction. The canopy chute 24 path and speed is maximized upward for containment and canopy deployment from the top of assembly. A conventional set of three trailing hooks, left, center and right edges of the rear containment plate of the vehicle are employed to activate underground trigger mechanisms for offset hazards of aboveground, concealed mines.

A centerline path marking system mounted at the rear containment plate is provided whereby a path centerline is prepared with wheel brush and air system and marking with specialized material/paint at coded spaced intervals. The system also automatically paints low spots and where not proofed, unchecked or skipped locations.

Figure 4:
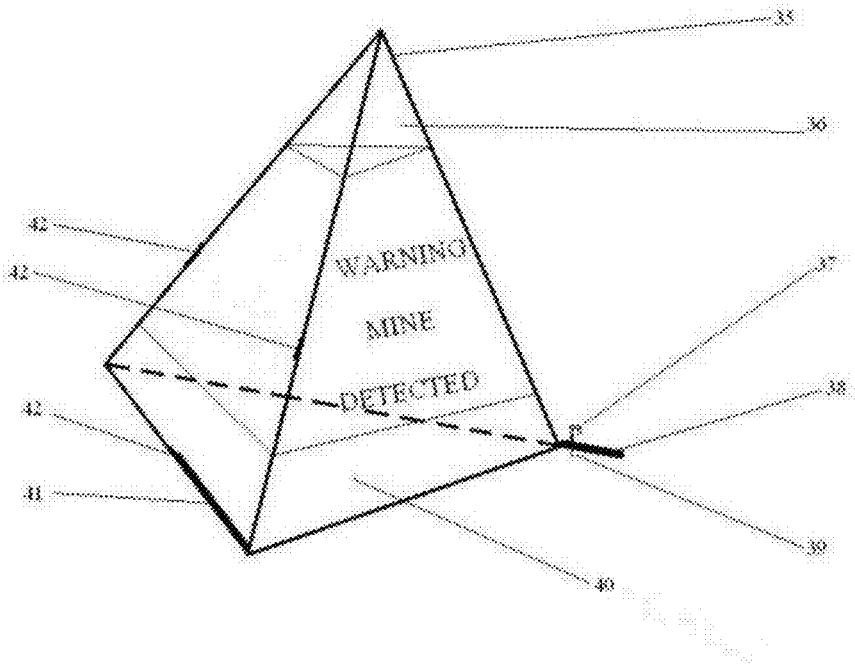
FIG. 4 is a perspective schematic view of a powder actuated warning flag.

FIG. 1 shows the warning flag tube 6 mounted on the top of the vehicles chassis. FIG. 4 illustrates the detail for the self-contained, remote deployed warning flag system. The vehicle carries a remote deployed powder actuated anchored unfolding warning flag 4 in the top or on the side of the lower chassis body. At this location or mounted onto the side of the chassis a single to several warning flags tubes can be stored. This self-contained function allows the administration of possible deactivation or detonation to be controlled in a more efficient manner in addition to keeping personnel involvement to a minimum for marking the hazard by remotely placing near to located hazards.

The individual flag 35 becomes upright when removed from tube and expand automatically with the individual sides being of flexible spring-to-rod 42 connections. Upon locating the anchor base 38 to its desired location by the operator, the base is positioned and trigger 37 discharged by the use of the robotic arm, securing it into the ground by the powder actuated anchor 39 making the flag spiked into the ground. An additional automatic trigger for discharge may be used at the far base location 41. To aid in the ability to weather wind conditions, the top and base are vented 36 & 40 open to reduce blow over affect.

The devices described herein, individually or in combination may be advantageously be fixed as attachments for or onto other vehicles to achieve desired results which are needed.

I claim:

1. An apparatus on a vehicle for containing landmine blasts, comprising:

a plurality of energy dissipating struts coupled to said a vehicle and a blast plate, wherein said struts are energy absorbing and connected on one end to said vehicle and on the opposite end to said blast plate;

the blast plate having a blast-resistant expanding billows, with a curtain system and an unfolding canopy mounted thereon, the expanding billows, with the curtain system and unfolding canopy providing three dimensional expansion in the event of a landmine detonation.

2. The apparatus of claim 1, further comprising a gas ejection system that ejects as following being triggered by a feedback loop system.

3. The apparatus of claim 2, wherein the gas ejection system ejects gas following a break in the feedback loop system to deploy the unfolding canopy and provide downward force.

4. The apparatus of claim 2, wherein the feedback loop system is broken by a detonation.

5. The apparatus of claim 1, further comprising:

a vertically oriented reciprocating probe, the probe being geometrically controlled by a vehicle-mounted controller that controls the probe with a hinged, articulated bracket; and at least one preloaded, pressurized strut that provides downward force.

6. The apparatus of claim 1, wherein a bottom of a hinged frame may contain a lower control arm with an axial actuator, wherein the lower control arm may have a controlled advance throughout a timed cycle of operation.

7. The apparatus of claim 1, further comprising a plurality of vertically controlled probes.

8. The apparatus of claim 1, wherein the vehicle is a robotic, remote controlled vehicle.

9. The apparatus of claim 1, further comprising:

a deflector with hinged plates mounted to the vehicle, the deflector pivotably mounted with hinge pins, wherein each hinge pin is bearing mounted to the vehicle provide a pivot axis segment that overlaps to provide a deflected angle from the vertical adjusting to an existing ground surface;

the deflector further supported by guide rollers for contoured movement on an uneven surface.

10. The apparatus of claim 9, wherein the deflector is further counterweighted so as to diminish the force of the deflector on the uneven surface.

11. The apparatus of claim 10, further comprising mine detector, wherein the mine detector is self contained and mounted behind a deflector in at least one of integrally attached fashion as to keep a predetermined minimum distance between the mine detector and the ground.

12. The apparatus of claim 1, further comprising:

a turret that houses at least one removable black box, at least one camera and a data processor, wherein the camera is mounted in a protective enclosure and the data processor provides for at least one of data transmission, card checking and motion detection.

13. The apparatus of claim 1, further comprising:

a mine marking system comprising the deployment of a marker upon detection of a mine.

14. The apparatus of claim 13, further comprising a tube that deploys the marker upon detection of a mine and wherein the marker expands to a predetermined size and shape upon deployment.

15. The apparatus of claim 14, wherein a plurality of markers are housed on the vehicle and are deployed individually by a robotic arm mounted on the vehicle and anchored to a desired position.

16. The apparatus of claim 1, further comprising:

a path marking system mounted on a rear of the vehicle that provides an indication of a path over which the vehicle has traveled.

17. The apparatus of claim 16, further comprising a sensor that detects low spots that have not been cleared and a predetermined marking applied to the low spots.

18. A landmine blast containment system comprising:

a vehicle;

a strut dissipating blast plate;

a blast resistant billows;

a blast resistant curtain; and a probe assembly that is vertically controlled and that is formed with a hinged assembly of linkages, the assembly of linkages comprising a first pin mounted to a rear portion of the vehicle with a spline bracket that controls at least one link in a vertical plane, a second pin connected to an adjacent link with a reciprocating head and a third pin connected to an axial linear actuator that terminates with a ball-type connection at a base of the vehicle;

wherein the probe assembly simultaneously reacts with the strut dissipating blast plate and wherein the strut dissipating blast plate is coupled to the blast resistant and absorbent billows and curtain.

19. The system of claim 18, further comprising a foldable canopy-positioned extension that contains fragmentation and further dissipates energy.

20. The system of claim 18, further comprising:

a gas ejection system;

a gas pressure vessel; and an electrical feedback loop;

wherein the gas ejection system and gas pressure vessel are housed in a protective enclosure and substantially instaneously release gas when the electrical feedback loop is broken.

21. The system of claim 20, wherein the electrical feedback loop is broken by an explosion.

22. The system of claim 18, further comprising:

a deflector with hinged plates, wherein the hinged plates individually pivot through the use of hinge pins and which contours to a surface over which the vehicle is moving.

23. The system of claim 22, further comprising a plurality of counterweighted rollers that support the deflector and which decrease the weight of the deflector on the surface over which the vehicle is moving.

24. The system of claim 22, further comprising:

a mine detector, the mine detector mounted in one of an integral attached manner proximate a bottom face of the deflector and oriented such that it maintains a predetermined distance from the surface over which the vehicle is moving.

25. The system of claim 18, further comprising:

a marker that marks the ground over which the vehicle is moving, wherein the marker comprises a plurality of flags that are extracted from a holding area of the vehicle by a robotic arm and placed in a desired location.

26. The system of claim 25, wherein the ground is marked with one of a plurality of spring-loaded flags in the shape of a pyramid.

27. The system of claim 18, further comprising:

an identification system that scans one of local signal data, card data and biometric data to determine identification of people in areas proximate to the system and wherein the identification system is mounted in a secure, protective housing.

28. The system of claim 18, further comprising a motion detector.

29. The system of claim 18, further comprising:

a path marker, wherein the path marker disperses at least one of a specialized paint marking at predetermined intervals under the vehicle that indicate a path is safe for travel.

30. The system of claim 29, wherein the path marker provides markings having a width of about 32 inches.

31. The system of claim 29, wherein the path marker further marks low spots that have not been cleared of landmines.

32. The system of claim 29, wherein the marking is coded and can be read to provide any of a plurality of information.

33. The system of claim 18, wherein the vehicle is powered by a green energy source.

* * * * *